US012152804B2

(12) United States Patent
Baxter et al.

(10) Patent No.: US 12,152,804 B2
(45) Date of Patent: Nov. 26, 2024

(54) TERMINAL UNIT CONTROL BOX BARRIER

(71) Applicant: Air Distribution Technologies IP, LLC, Milwaukee, WI (US)

(72) Inventors: Phillip Addison Baxter, Dallas, TX (US); Alexander Contreras, Dallas, TX (US); Chris Theodore Way, Enchanted Oaks, TX (US); Cameron Travis West, Dallas, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 493 days.

(21) Appl. No.: 17/480,997

(22) Filed: Sep. 21, 2021

(65) Prior Publication Data

US 2023/0069037 A1 Mar. 2, 2023

Related U.S. Application Data

(60) Provisional application No. 63/237,382, filed on Aug. 26, 2021.

(51) Int. Cl.

| | |
|---|---|
| ***F24F 13/20*** | (2006.01) |
| ***F24F 11/89*** | (2018.01) |
| ***F24F 13/10*** | (2006.01) |

(52) U.S. Cl.

CPC ..... *F24F 13/20* (2013.01); *F24F 11/89* (2018.01); *F24F 13/10* (2013.01)

(58) Field of Classification Search

CPC ..... F24F 13/10; F24F 13/20; F24F 11/89
USPC ..... 454/352
See application file for complete search history.

(56) References Cited

U.S. PATENT DOCUMENTS

| | | | | |
|---|---|---|---|---|
| 4,997,030 | A * | 3/1991 | Goto | F24F 11/76 236/51 |
| 5,004,149 | A * | 4/1991 | Narikiyo | F24F 11/76 236/49.3 |
| 5,179,524 | A * | 1/1993 | Parker | F24F 11/77 165/238 |
| 6,079,626 | A * | 6/2000 | Hartman | F24F 1/00075 236/13 |
| 8,038,075 | B1 * | 10/2011 | Walsh | F24F 13/1426 236/51 |
| 9,939,171 | B2 * | 4/2018 | Lollar | F24H 9/2071 |
| 10,295,215 | B2 * | 5/2019 | Du | F24F 13/1426 |
| 2005/0087614 | A1 * | 4/2005 | Ruise | F24F 7/06 62/186 |
| 2013/0049644 | A1 * | 2/2013 | Neumann | F24F 13/1426 318/15 |

(Continued)

*Primary Examiner* — Avinash A Savani
*Assistant Examiner* — Dana K Tighe
(74) *Attorney, Agent, or Firm* — Michael Best & Friedrich LLP

(57) ABSTRACT

The present disclosure is directed to a terminal unit of a heating, ventilation, and/or air conditioning (HVAC) system. The terminal unit includes a control box assembly including an electric enclosure with electronics disposed within a cavity of the electric enclosure. The terminal unit also includes a duct assembly including a casing and a control valve configured to coordinate with the electronic controls to manage air flow through the casing. Further, the terminal unit includes a see-through barrier coupled to the electric enclosure such that the electronics are positioned between a base of the electric disclosure and the see-through barrier.

19 Claims, 7 Drawing Sheets

(56) References Cited

U.S. PATENT DOCUMENTS

| | | | | |
|---|---|---|---|---|
| 2013/0173064 | A1* | 7/2013 | Fadell | H04L 67/10 700/276 |
| 2015/0176853 | A1* | 6/2015 | Uden | G05D 23/1934 700/276 |

* cited by examiner

TERMINAL UNIT CONTROL BOX BARRIER

CROSS-REFERENCE TO RELATED APPLICATION

This application is a continuation of U.S. Provisional Application No. 63/237,382, filed on Aug. 26, 2021, with the title "Terminal Unit Control Box Barrier", which is hereby incorporated by reference in its entirety.

BACKGROUND

This section is intended to introduce the reader to various aspects of art that may be related to the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. An HVAC system may control the environmental properties through control of properties of an air flow delivered to and ventilated from spaces serviced by the HVAC system. For example, the HVAC system may transfer heat between the air flow and refrigerant flowing through the system (e.g., a heat exchanger) to provide cooled air for an indoor environment. Similarly, the HVAC system may heat the air flow to provide warmth to an indoor environment. In some situations, the HVAC system may even provide cooling of the air flow followed by heating of the air flow to limit humidity while providing air at a desired temperature to the indoor environment. The HVAC system may also control a flowrate of the air flow to manage (e.g., expedite transitioning between) environmental conditions.

Terminal units, which may also be referred to as variable air volume (VAV) systems, may be part of an HVAC system. Modern buildings often utilize terminal units to control air distribution. That is, terminal units coordinate with other air conditioning components (e.g., an air handling system) to facilitate supply of conditioned air to various different locations or zones (e.g., separate rooms or areas within a building). Terminal units often employ electrically powered components, such as controllers, actuators, sensors, heaters, and the like to more specifically manage environmental conditions in respective zones. When working with terminal units, such as during maintenance operations or HVAC installations, it may be necessary for people to troubleshoot these electrically powered components. For example, during assembly, installation, testing, or maintenance operations associated with terminal units, it may be necessary to study or observe the associated electrically powered components to identify faulty electrical issues (e.g., burned out fuses, faulty connections, or shorted wiring).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a terminal unit for a heating, ventilation, and/or air conditioning (HVAC) system is provided. The system includes a control box assembly including an electric enclosure. A cavity of the electric enclosure is defined by a base and sides of the electric enclosure. Terminal unit electronics are disposed within the cavity of the electric enclosure. The system also includes a duct assembly including a casing, a control valve configured to coordinate with the terminal unit electronics to manage air flow through the casing. Further the system includes a see-through barrier coupled to the electric enclosure and positioned such that the terminal unit electronics are located between the base of the electric enclosure and the see-through barrier.

In an embodiment, a terminal unit for a HVAC system is provided that includes a control box assembly of the system with an electric enclosure that defines a cavity therein. Terminal unit electronics are disposed within the cavity of the electric enclosure. The system also includes a duct assembly with a casing configured to transmit an air flow. Further, the system includes a heater, a fan, a valve, or a combination thereof configured to operate with the terminal unit electronics to adjust one or more aspects of the air flow. A see-through barrier is coupled to the electric enclosure and positioned within the cavity such that the terminal unit electronics are located between a base of the electric enclosure and the see-through barrier.

In an embodiment, a terminal unit for a heating, ventilation, and/or air conditioning (HVAC) system is provided with an electric enclosure including an interior and a portal into the interior of the electric enclosure. Receptacles of a base of the electric enclosure are configured to engage with terminal unit electronics and at least one air flow characteristic management device. A duct assembly casing of the system is coupled to the electric enclosure, wherein the duct assembly casing is configured to transmit an air flow. A see-through barrier is coupled to the electric enclosure and positioned such that physical access to the receptacles via the portal is blocked by the see-through barrier.

BRIEF DESCRIPTION OF THE DRAWINGS

Various objects, aspects, features, and advantages of the disclosure will now become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Figure 1:
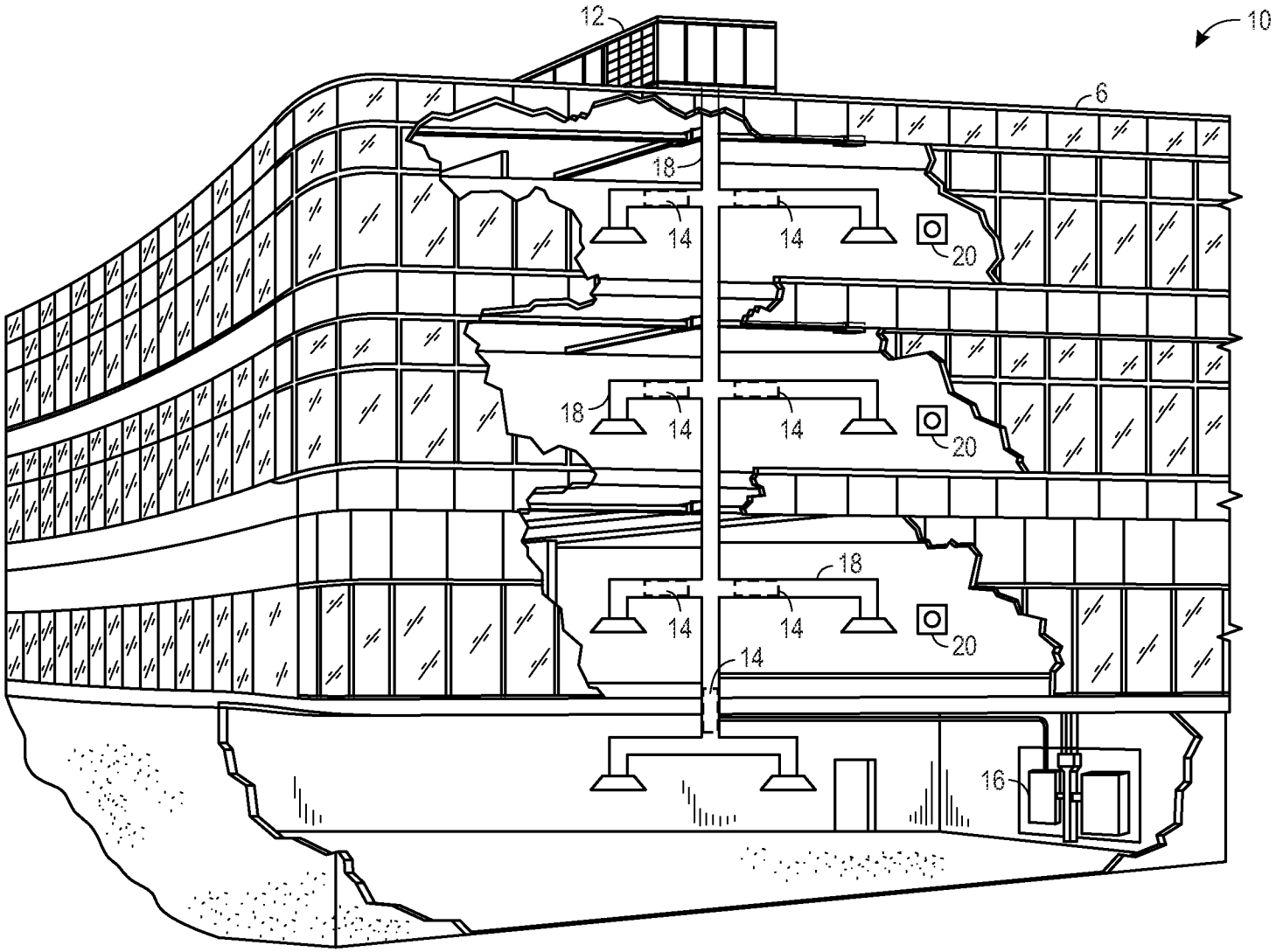
FIG. 1 is a perspective view of an embodiment of a heating, ventilation, and/or air conditioning (HVAC) system for environmental management that may employ one or more terminal units, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terminals "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

It is now recognized that certain procedures related to working on terminal units (e.g., maintenance and assembly of terminal units) are inefficient because of complications associated with working directly with or within a proximity of certain electrical connections (e.g., high voltage components) of the terminal units. Thus, it is now recognized that there is a need to provide terminal unit features that operate to improve efficiencies associated with maintaining, installing, and managing terminal units. Embodiments of the present disclosure include features that address this need.

The present disclosure is directed to a see-through barrier for a control box of a terminal unit or VAV unit. The see-through barrier, which may be transparent (e.g., clear plastic) or translucent (e.g., cloudy plastic, a wire or thread mesh) may be positioned over functional components (e.g., a controller, terminal blocks, fuses, switches, and/or transformers) of the terminal unit and designed to interface with other aspects of the terminal unit (e.g., a housing) to block physical access to such components. For example, the see-through barrier may be positioned adjacent to an access port of a control box of the terminal unit such that the see-through barrier blocks physical access into a cavity of the control box that houses certain electrical components (e.g., high voltage components) or components that it is desirable to protect from inadvertent contact. Thus, the see-through barrier may operate to isolate or cover functional components in a way that blocks a user's fingers or hand from extending through the access port and touching the functional components. By blocking access in this way, present embodiments allow a user to observe functional components within the control box (by looking through the see-through barrier) without taking precautions required for dealing with certain electrical components (e.g., components connected to high voltage). Further, the see-through barrier may be made of highly electrically insulative material, which may further block electrical contact, such as via arcing, with an observer.

In view of the foregoing, present embodiments, as compared to traditional terminal units, may provide improved and more efficient accessibility to internal features of a terminal unit. This may in turn facilitate troubleshooting, installation, maintenance, and so forth. For example, in situations where high voltage is employed within a terminal unit's control box, the use of the see-through barrier may eliminate a need for a maintenance person to put on special clothing, employ specialized equipment, or otherwise prepare for interfacing with the high voltage. Further, employing the see-through barrier in the terminal unit may allow an unskilled laborer (e.g., someone that is not a qualified electrician) to observe aspects of the control box while maintaining an appropriately insulated position with respect to the functional components. For example, a worker that is not trained as an electrician may be able to open a door (e.g., an opaque metal door) to the control box and readily observe, via the see-through barrier, whether there are visible indications of faults. As a specific example, the worker may be able to observe certain fuses disposed behind the barrier have been burned out and then report that information to someone (e.g., a trained electrician) that is equipped with the proper knowledge and tools to address associated repairs or replacements.

As used herein, an HVAC system may be defined as including any number of components configured to enable regulation of parameters related to climate characteristics, such as temperature, humidity, air flow, air pressure, air quality, and so forth. Components or parts of an HVAC system may include, but are not limited to, all, some of, or individual parts, such as a heat exchanger, a heater, an air flow control device (e.g., a fan), a sensor configured to detect a climate characteristic or operating parameter, a filter, a control device configured to regulate operation of an HVAC system component, a component configured to enable regulation of climate characteristics, a terminal unit, or a combination thereof. An HVAC system includes a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

Turning now to the drawings, FIG. 1 illustrates a building 6 including an embodiment of a heating, ventilation, and/or air conditioning (HVAC) system 10 for environmental management that may employ one or more HVAC units 12 and terminal units 14. The HVAC system 10 may include a central controller 16 to manage certain functions of the HVAC system 10. However, various components of the HVAC system 10 may include local control features as well.

For example, one or more of the terminal units 14 or VAV units may include a local controller (e.g., control circuitry, an automation controller, or programmable logic controller). Further, the terminal units 14 may include input and output devices that coordinate with the local controller and/or the central controller 16. For example, the terminal units 14 may include sensors (e.g., an airflow sensor), actuators (e.g., a valve or damper) and other features (e.g., a heater) for facilitating climate management control operations.

In the illustrated embodiment, the building 6 is air conditioned by the HVAC system 10, which includes the HVAC unit 12. The building 6 may be a commercial structure or a residential structure. As shown, the HVAC unit 12 is disposed on the roof of the building 6; however, the HVAC unit 12 may be located in other areas, such as equipment rooms or locations adjacent the building 6. The HVAC unit 12 may be a single package unit containing other equipment, such as a blower, integrated air handler, and/or auxiliary heating unit. In other embodiments, the HVAC unit 12 may be part of a split HVAC system, which may include an outdoor HVAC unit and an indoor HVAC unit.

The HVAC unit 12 is an air cooled device that implements a refrigeration cycle to provide conditioned air to the building 6. Specifically, the HVAC unit 12 may include one or more heat exchangers across which an air flow is passed to condition the air flow before the air flow is supplied to the building 6. In the illustrated embodiment, the HVAC unit 12 is a rooftop unit (RTU) that conditions a supply air stream, such as environmental air and/or a return air flow from the building 6. After the HVAC unit 12 conditions the air, the air is supplied to the building 6 via ductwork 18 extending throughout the building 6 from the HVAC unit 12. For example, the ductwork 18 may extend to various individual floors or other sections (or zones) of the building 6. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

In the illustrated embodiment, a control device 20, one type of which may be a thermostat, may be used to designate the temperature of the conditioned air for a particular area or zone. The control device 20 also may be used to control the flow of air through the ductwork 18. For example, the control device 20 may be used to regulate operation of one or more components of the HVAC unit 12 or other components, such as dampers and fans, within the building 6 that may control flow of air through and/or from the ductwork 18. Specifically, for example, each of the control devices 20 may coordinate with an associated one or set of the terminal units 14 to facilitate climate control within a respective zone of the building 6. As will be discussed further below, the terminal units 14 may include various control features that can operate locally and/or in combination with centralized control to facilitate climate management within the building 6. Devices that are controlled to manage air flow characteristics (e.g., temperature, flow rate), such as fans, heaters, heat exchangers, and valves, may cumulatively be referred to as air flow characteristics management devices.

A terminal unit (e.g., terminal unit 14), which may also be referred to as a VAV box or VAV unit, may be defined as a device that operates to control a volume of conditioned air used to regulate thermal conditions in an area serviced by the terminal unit. Systems of terminal units (VAV systems) may supply air received from an air handling unit to different zones at varying temperatures and flow rates to meet respective heating and cooling needs of the different zones. Numerous terminal units, such as the terminal units 14 illustrated in FIG. 1, may be used to service various different areas or zones (e.g., rooms) within a larger conditioned space (e.g., a building). Typically, a single terminal unit 14 (VAV box or VAV unit) is used per zone. Multiple of the terminal units 14 positioned throughout the building 6 (which may be representative of any of various environments designated for climate control) may receive cool or warm air from the same cooling or heating components of the HVAC system 10. For example, an air handler of the HVAC system 10 may work with an air conditioner of the HVAC system 10 to provide cooled air to each of the terminal units 14 within the building 6. The cooled air provided by the HVAC system 10 to the terminal units 14 may be consistently conditioned when supplied but may change as it passes through various lengths of the ductwork 18 to reach different zones. Also, the air flow supplied by the HVAC system 10 may have properties (e.g., a low temperature) that are desirable for some zones (e.g., based on a setting of the control device 20 in the relevant zone) but not others. Accordingly, the terminal units 14 may operate to provide adjustments (e.g., temperature control or volume control) based on localized zone settings. In other words, the terminal units 14 may include features that operate to customize certain atmospheric conditions for the zones respectively serviced by the terminal units 14.

As noted above, an air flow received by a terminal unit may be modified by the terminal unit to achieve desired thermal conditioning for a particular area. For example, when the air flow arrives to the terminal unit at a temperature below a temperature setting for a zone supplied by the terminal unit, heating operations for the air flow may be provided by the terminal unit. Specifically, for example, an electric heater integrated with a terminal unit may perform localized heating of air that passes through the terminal unit. Such heating operations may be performed by the terminal unit as part of a reheating function employed in situations (e.g., humid areas) where air is being cooled below a desired temperature level for a controlled environment to limit humidity in a climate controlled environment. That is, the air may be cooled below a certain temperature to encourage water to drop out of the air and then the air may be reheated by a heater of the terminal unit to a more comfortable temperature for occupants of a room at the terminal unit before the air actually enters the room. The heater may be representative of an electric heater, a heat exchanger or the like. In some embodiments, a heat exchanger may be employed to further cool an airflow.

Figure 2:
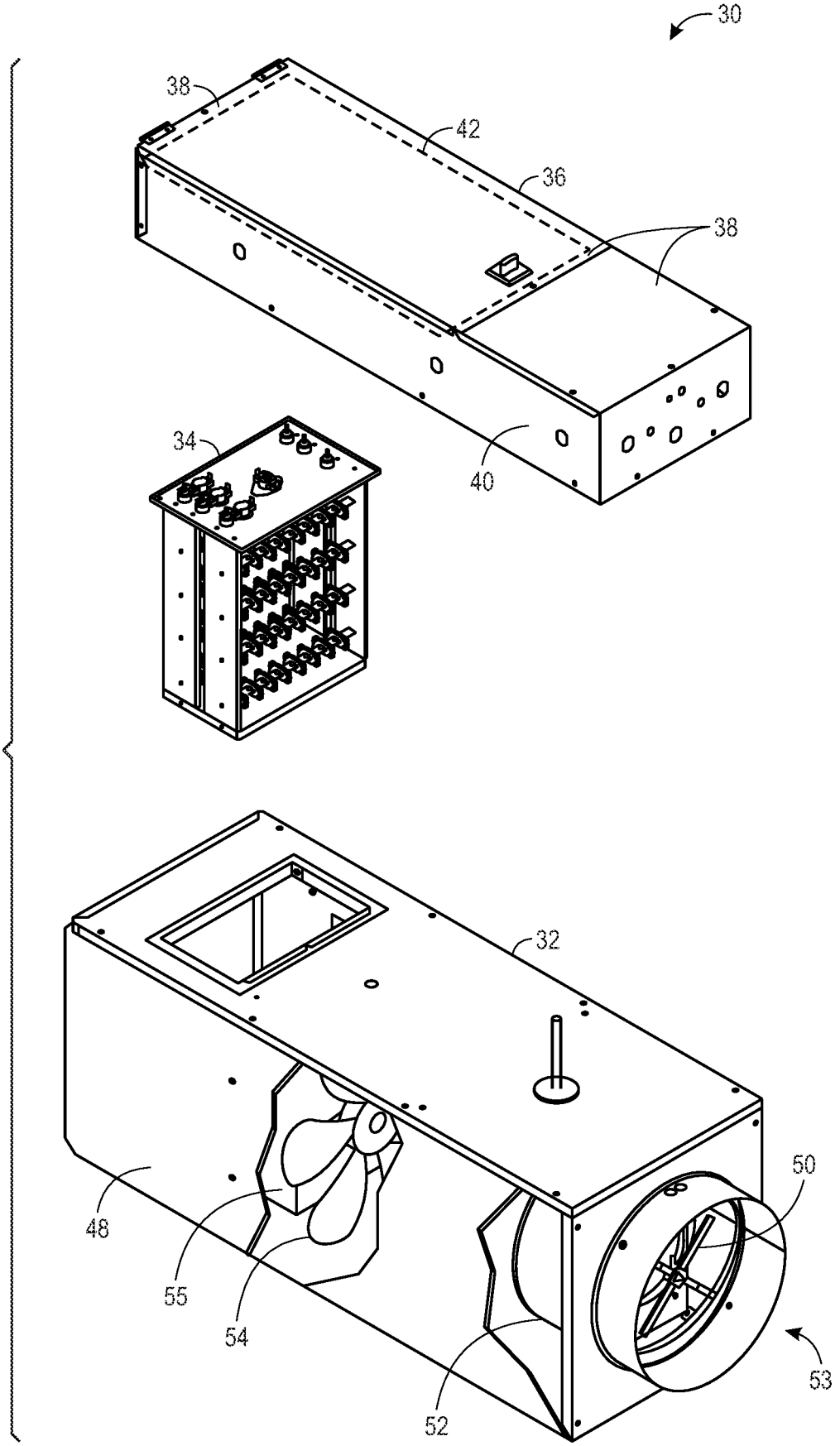
FIG. 2 is an exploded perspective view of a terminal unit including a duct assembly, a heater, and a control box assembly, in accordance with an aspect of the present disclosure.

FIG. 2 is an exploded perspective view of a terminal unit 30 including a duct assembly 32, a heater 34, and a control box assembly 36, in accordance with present embodiments. In the illustrated embodiment of FIG. 2, outer panels 38 of the control box assembly 36 are secured to a body 40 (or electrical enclosure 40) of the control box assembly 36 and blocking access to internal features of the control box assembly 36. The outer panels 38 may include door assemblies (e.g., door panels that rotate about one or more hinges to transition between open and closed configurations to provide or block access to internals of the control box assembly body 40, respectively) Additionally, disposed within the control box assembly 36 is a see-through panel 42 or see-through barrier 42, which is illustrate in dashed lines in FIG. 2, that further blocks access to components (e.g., high voltage components) of the control box assembly 36. However, when the outer panel 38 adjacent the see-through panel 42 is removed (e.g., transitioned to an open position about hinges 44) to reveal an access port (or portal) of the control box assembly 36, the see-through panel 42 blocks physical access to the access port while still allowing visual access to the components disposed behind the see-through panel 42. Thus, the see-through panel 42 prevents physical contact with the components via the portal exposed by opening or otherwise removing the outer panel 38 adjacent the see-through panel 42. This allows for more efficient operation and maintenance related to the control box assembly 36. For example, in traditional systems, a terminal unit may need to be fully powered down to simply perform diagnostics because of potential exposure to electricity. However, the see-through barrier 42 (e.g., a plastic plate with small openings, a wire mesh made of insulative material, clear plastic), which may be made of transparent and insulative material (e.g., polycarbonate) may address procedural issues with working proximate the electrical equipment and allow observation without shutting power to the terminal unit down completely.

The control box assembly 36 controls an air volume to a zone of a building or other area by operating an airflow control valve (e.g., a controlled damper) in the duct assembly 32 based on air flow sensing. The duct assembly 36 may include a casing 48 (e.g., a rectangular casing that is configured to engage with ductwork to provide fluid coupling between the casing and the ductwork), a flow sensor 50, and a damper 52 (including an actuator). Typically, an inlet 53 to the casing 48 is round and incorporates (e.g., is coupled with) the flow sensor 50 and the damper 52 (also referred to as a control valve). In some embodiments, the duct assembly 36 may also include a fan 54 including fan blades coupled about a shaft and driven by a motor 55. In the illustrated embodiment, the duct assembly 36 also incorporates the heater 34 (e.g., an electric heater), which engages with the control box assembly 36 and can be used to warm air passing through the terminal unit 30. Specifically, for example, the heater 34 may be employed for reheat purposes when air has been cooled below a comfortable temperature range to facilitate reduction in humidity in the air.

Features of the terminal unit 30, such as the heater 34, the damper 52, and the fan 54 may require a supply of high voltage electricity to operate. Thus, control features, power components, electrical couplings (e.g., couplings to a heater, control valve, or fan), electric conductors, fuse boxes, contacts, and the like (which may cumulatively or generally be referred to as terminal unit electronics) in the control box assembly 36 may provide or operate under such high voltages. Thus, maintenance checks and servicing may be hindered by procedures required for dealing with such components. However, present embodiments limit exposure to these items during routine maintenance procedures, which can make such procedures much more efficient than what is required for traditional terminal units. For example, a typical maintenance operation includes checking the heater 34 (e.g., a reheat coil) to ensure electrical connections are in place, there are no signs of overheating, and that connectors and conductors are not observably faulty. Similar checks may be desirable for numerous components stored within the control box assembly 36. By providing the see-through barrier 42 between an access portal and the relevant components (e.g., a high voltage connection to the heater 34, an actuator of the damper 52, or a motor of the fan 54), observations can be made about these features without requiring a shutdown of the terminal unit 30, specialized equipment, or the presence of individuals that are specialized in dealing with such situations. For example, a non-electrician may be able to observe or even take a picture of equipment through the see-through barrier 42 and report back to an electrician without having to have potential contact with the high voltage equipment. This creates various efficiencies, such as more efficient utilization of time spent by higher paid employees (e.g., a layman tech can investigate and observe wiring/electrical components and report back to a more highly paid manager). It should be noted that present embodiments are not limited to blocking access to high voltage equipment. Present embodiments may also protect other types of equipment (e.g., delicate connections) from undesirable contact.

Figure 3:
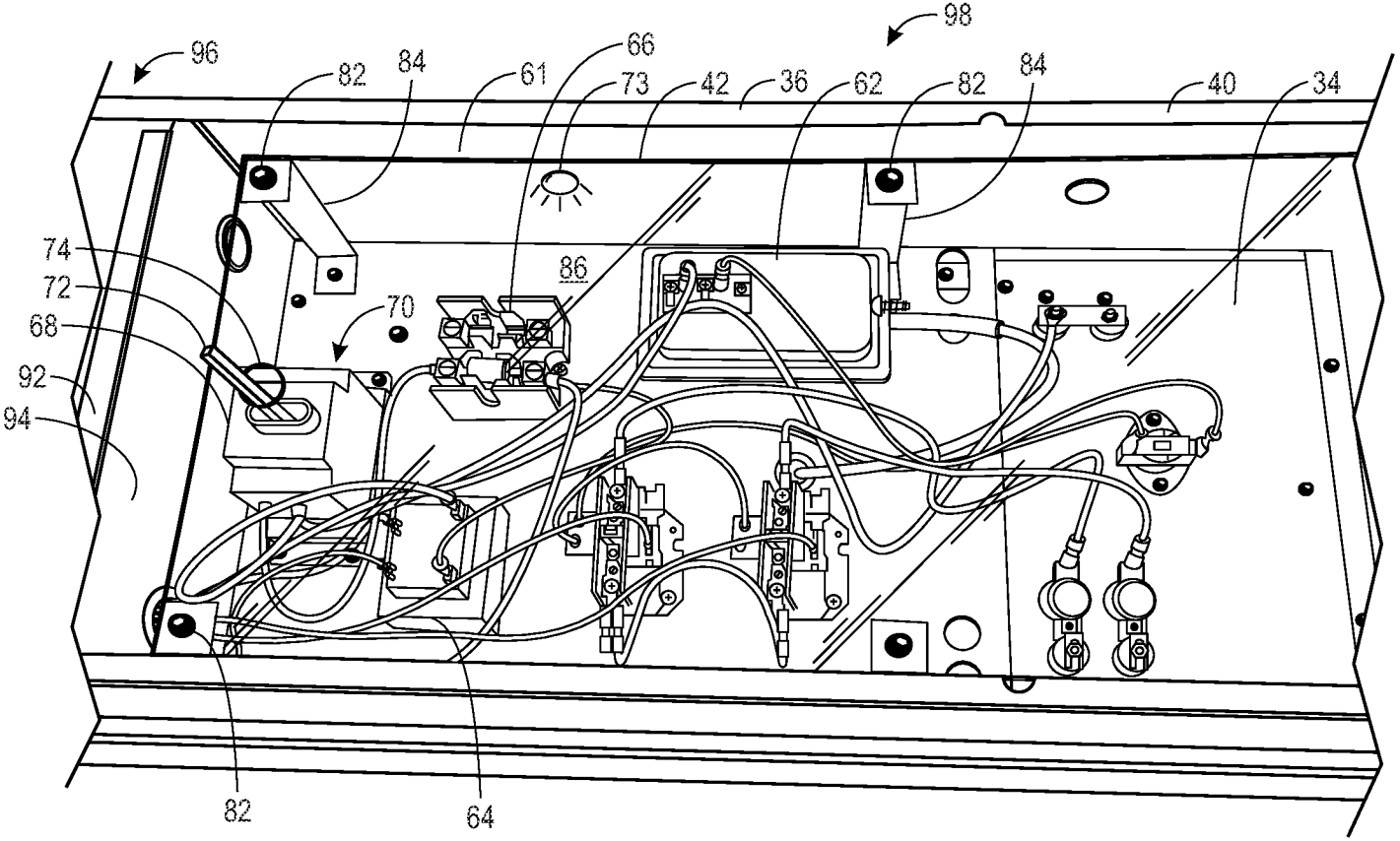
FIG. 3 is an overhead perspective view into the electrical enclosure of the control box assembly with the outer panels removed, in accordance with an aspect of the present disclosure.

FIG. 3 is an overhead perspective view into the electrical enclosure 40 of the control box assembly 36 with the outer panels 38 removed to expose a portal 61 in accordance with embodiments of the present disclosure. Specifically, FIG. 3 illustrates the see-through barrier 42 positioned over various electronic components of the control box assembly 36, including the heater 34, an air flow switch 62, a transformer 64, fuses 66, and a connector base 68. The connector base 68 is a portion of a connector 70 (e.g., an interlocking connector switch) that includes a coupler 72 (also referred to as a disconnect rod) that extends through an opening 74 in the see-through barrier 42 to facilitate secured engagement with one or more of the outer panels 38. The coupler 72 may be electrically isolated from other components positioned behind the see-through barrier 42. Accordingly, access to the coupler 72 can be unhindered by the see-through barrier 42, which allows the coupler 72 to secure directly to the outer panel 38 (access door) when the outer panels 38 are in a closed position (closing off the portal 61). The connector 70 can be activated to open or close via any of various techniques including a push-push operation, electronic activation, key-based operation, and the like. In some embodiments, the connector 70 may be excluded. Likewise, the outer panels 38 may be excluded (e.g., in low dust environments). In addition to the components listed above, in some embodiments, lights 73 may be disposed in the electrical enclosure 40 to further facilitate observation of the components disposed therein via the see-through barrier 42. In fact, indicator lights may be employed to prominently indicate issues such as burned out fuses.

As illustrated in FIG. 3, the see-through barrier 42 is secured to the electrical enclosure 40 via fasteners 82 (e.g., screws) and brackets 84 that extend from a base 86 of the electrical enclosure 40 to the see-through barrier 42. The brackets 84 may be sized to accommodate functional requirements for sufficiently distancing electrical components from a user observing them via the see-through barrier 42 or to accommodate ventilation requirements. In the illustrated embodiment, for example, the see-through barrier 42 is positioned approximately four inches away from the base 86. Thus, the brackets 84 are approximately four inches in length. While alternative positioning is contemplated, in the illustrated embodiment, the brackets 84 are positioned proximate corners of the electrical enclosure 40 and the see-through barrier 42 coordinates with walls 88 of the electrical enclosure 40 to block physical access into the electrical enclosure 40. For example, gaps between the walls 88 and edges of the see-through barrier 42 may be limited to a size (e.g., less than a centimeter) that prevents a human finger from going around the see-through barrier 42. Additionally, it should be noted that one edge 92 of the see-through barrier 42 abuts an internal wall 94 of the electrical enclosure 40. The internal wall 94 partially defines a separate cavity 96 (separate from a cavity 98) of the electrical enclosure 40. This arrangement allows for certain components within the electrical enclosure 40 (e.g., within the separate cavity 96) to be accessible (physically accessible via the portal 61 or opening into the electrical enclosure 40 that is exposed when one or more of the outer panels 38 is removed) even when the see-through barrier 42 is secured in engagement with the electrical enclosure 40 (e.g., secured via the brackets 84).

Figure 4:
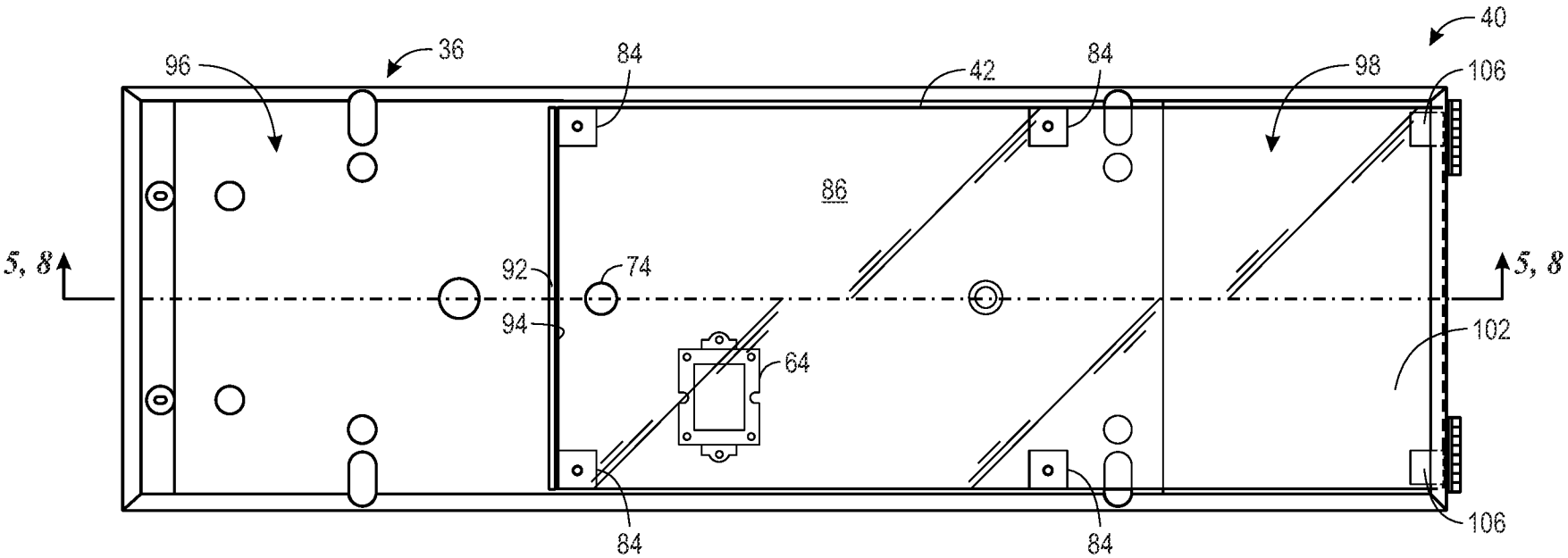
FIG. 4 is a plan view of the control box assembly with the outer panels removed, in accordance with an aspect of the present disclosure.
Figure 5:
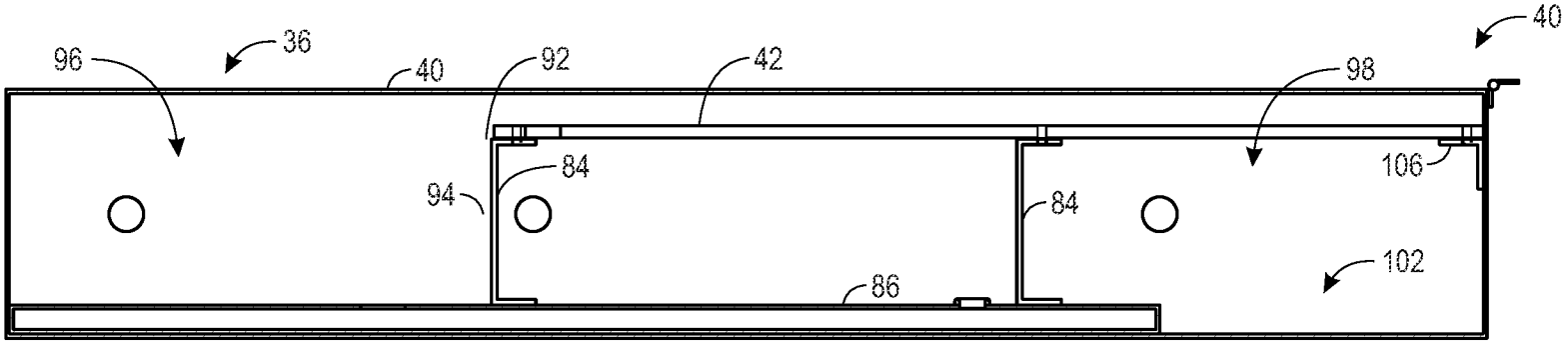
FIG. 5 is a cross-sectional side view of the control box assembly of FIG. 4, in accordance with an aspect of the present disclosure.

FIG. 4 is a plan view of the control box assembly 36 with the outer panels 38 removed, in accordance with embodiments of the present disclosure. In the illustrated embodiment of FIG. 4, the transformer 64 is disposed within the electrical enclosure 40 beneath the see-through barrier 42. Further, the see-through barrier 42 extends over an access port 102 for receiving the heater 34. The see-through barrier 42 couples with four of the brackets 84, which extend from the base 86, and edges of the see-through barrier 42 engage with tabs 106 or brackets extending from walls 108 the electrical enclosure 40. This engagement of the edges of the see-through barrier 42 may operate to resist deflection or bending of the see-through barrier 42, thus preventing physical access around the edges of the see-through barrier 42. FIG. 5 is a cross-sectional side view of the control box assembly 36 of FIG. 4 and may further illustrate a nature of this engagement of the see-through barrier 42 with the indicated features (e.g., brackets 84, tabs 106) associated with and part of the electrical enclosure 40. It should also be noted that the separate cavity 96 is not covered by the see-through barrier 42 and, thus, physical access to the separate cavity 96 can be had while the see-through barrier 42 remains in place.

Figure 6:
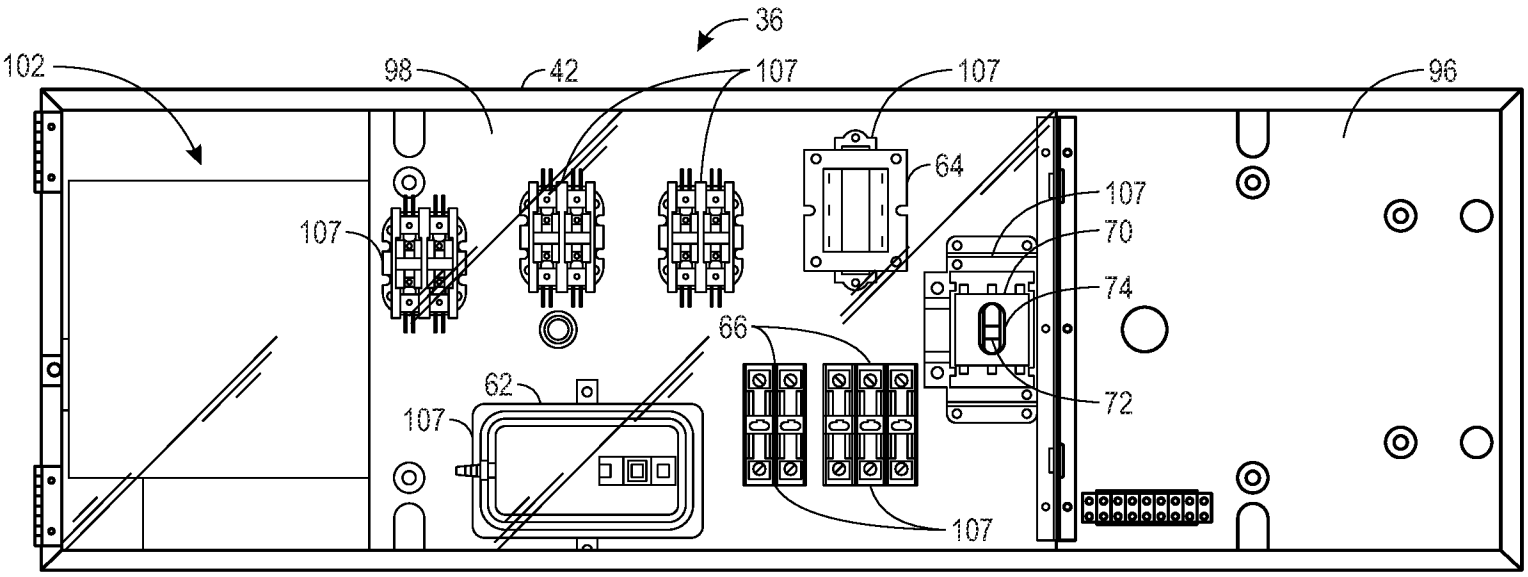
FIG. 6 is a plan view of the control box assembly with the outer panels removed and including various electrical components, in accordance with an aspect of the present disclosure.

FIG. 6 is a plan view of the control box assembly 36 with the outer panels 38 removed and including various electrical components 107, in accordance with embodiments of the present disclosure. As illustrated, the electrical enclosure 40 includes the access port 102 for the heater 34, while housing the electrical components 107 including the air flow switch 62, the transformer 64, the fuses 66, and the connector 70. As previously noted, the coupler 72 of the connector 70 extends through the opening 74 in the see-through barrier 42 to enable engagement with one or more of the outer panels 38. FIG. 6 clearly illustrates the cavity 98, which is covered by the see-through barrier 42 and the separate cavity 96, which is exposed and accessible.

Figure 7:
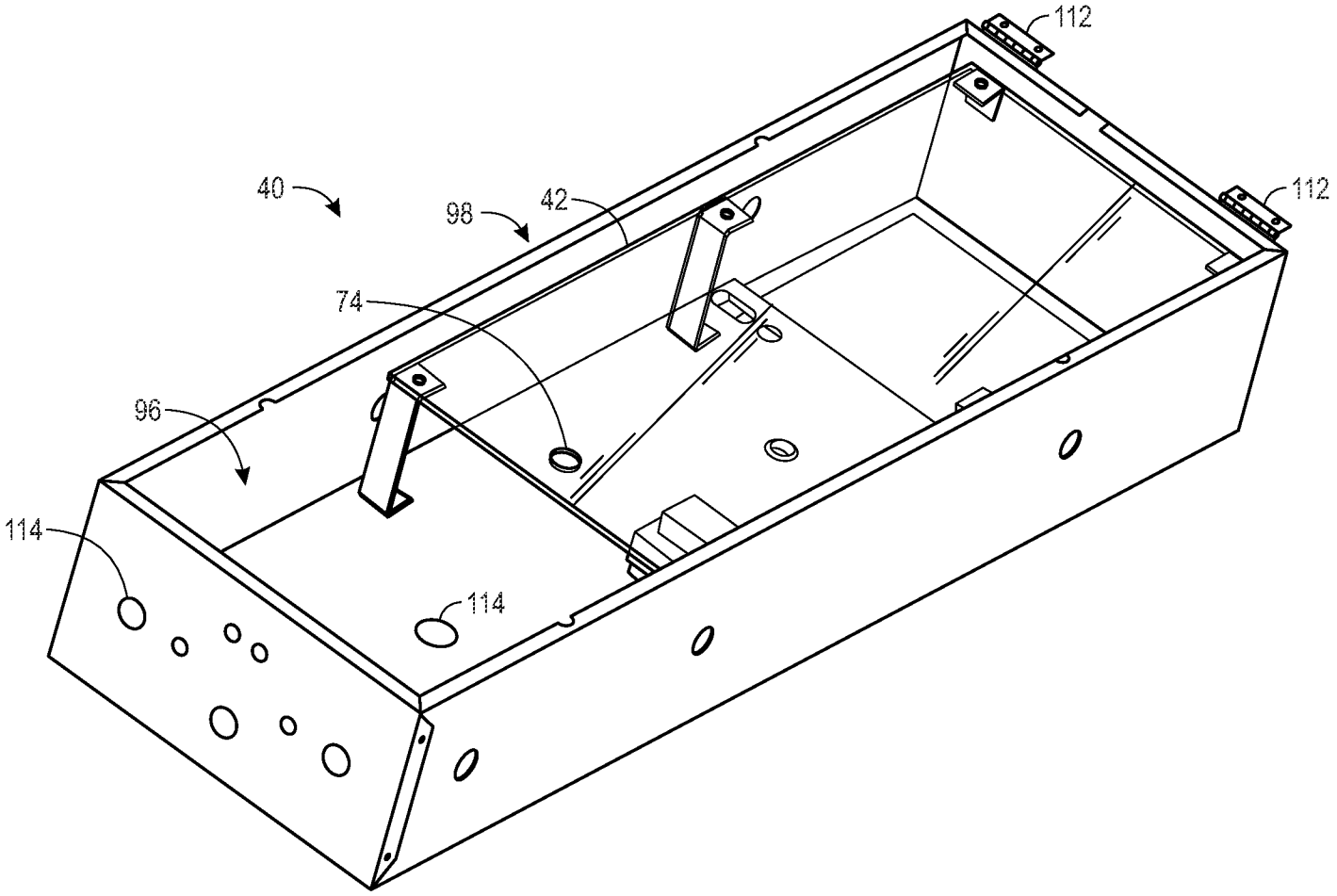
FIG. 7 is a perspective view of the electrical enclosure, in accordance with an aspect of the present disclosure.
Figure 8:
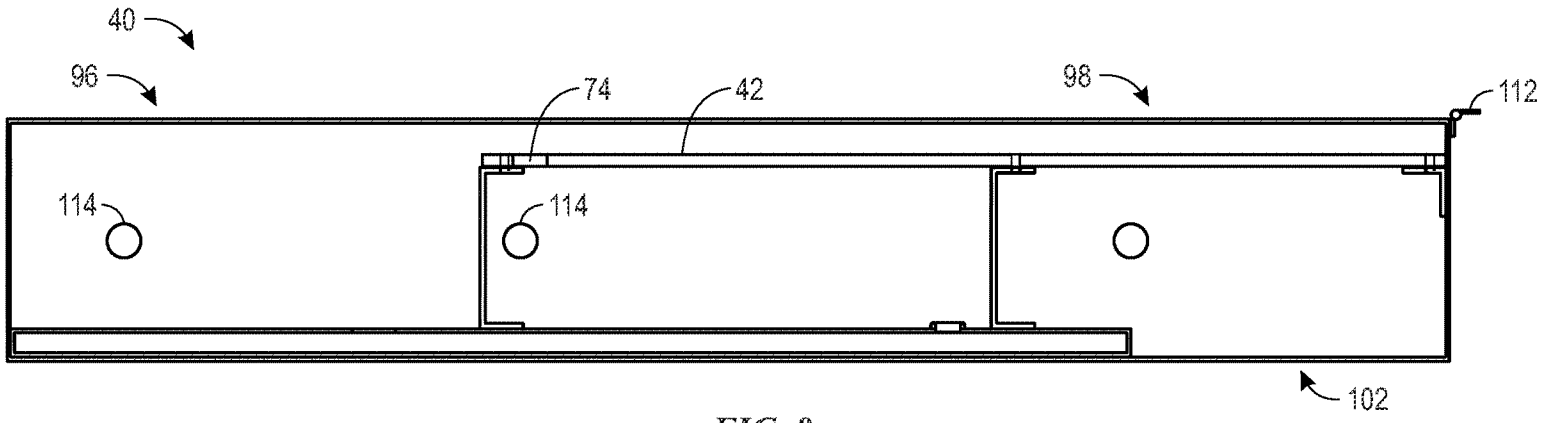
FIG. 8 is a cross-sectional side view of the electrical enclosure illustrated in FIG. 7, in accordance with an aspect of the present disclosure.
Figure 9:
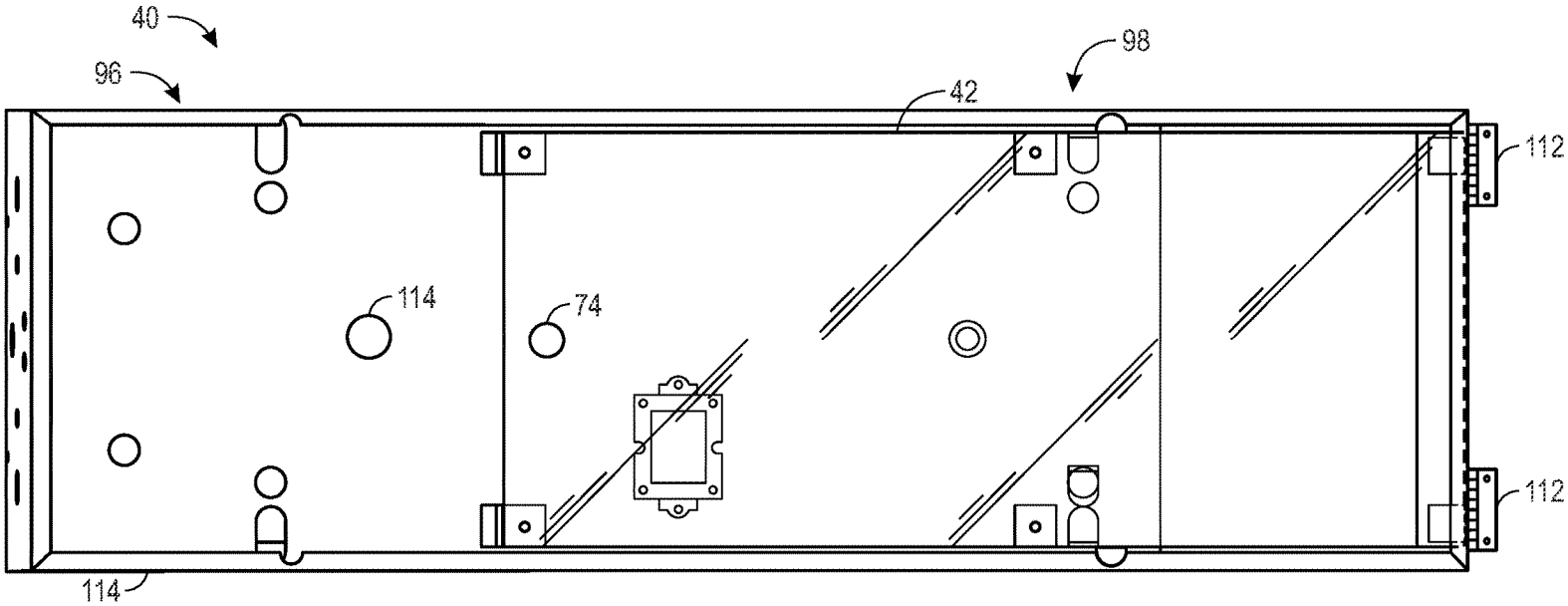
FIG. 9 is an overhead view of the electrical enclosure illustrated in FIGS. 7 and 8, in accordance with an aspect of the present disclosure.

FIG. 7 is a perspective view of the electrical enclosure 40, in accordance with present embodiments. In the illustrated embodiment of FIG. 7, the outer panels 38 have been removed. However, hinges 112 for coupling to at least one of the outer panels 38 are illustrated. FIG. 8 is a cross-sectional side view of the electrical enclosure 40 illustrated in FIG. 7. The access port 102 for receiving the heater 34, the cavity 98, and the separate cavity 96, are each clearly visible in the side view provided by FIG. 8. Further, FIG. 9 provides an overhead view of the electrical enclosure 40 illustrated in both FIG. 8 and FIG. 9. Each of the views provided in FIGS. 7, 8, and 9 provides a different perspective of the control box assembly 36 and the various features (e.g., openings 114) that facilitate coupling with electronics, ventilation and so forth. The openings 114 designed for coupling to electronics (which may include access port 102), may be referred to as terminal unit electronics receptacles 114 and openings 114 for ventilation may be referred to as ventilation receptacles 114. Also, prominently illustrated in each of these figures is the see-through panel 42 or see-through barrier 42, which includes at least one opening (e.g., the opening 74) to allow for secured coupling of a door or panel (e.g., one of the outer panels 38). In some embodiments, no opening is used because a securement mechanism (such as the connector 70) is not employed or is located elsewhere. As previously noted, the see-through panel 42 provides for separation of electrical components (or other components that it is desirable to protect from physical contact) from a user during maintenance procedures, testing procedures, status checks, and the like. This allows for efficient management of terminal units and personnel.

While only certain features and embodiments of the disclosure have been illustrated and described, many modifications and changes may occur to those skilled in the art, such as variations in sizes, dimensions, structures, shapes, and proportions of the various elements, values of parameters including temperatures and pressures, mounting arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort, to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designed as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A terminal unit for a heating, ventilation, and/or air conditioning (HVAC) system, comprising:

a control box assembly including an electric enclosure;

a cavity of the electric enclosure defined by a base and sides of the electric enclosure;

terminal unit electronics disposed within the cavity of the electric enclosure;

a duct assembly including a casing;

a control valve configured to coordinate with the terminal unit electronics to manage air flow through the casing;

a see-through barrier coupled to the electric enclosure and positioned such that the terminal unit electronics are located between the base of the electric enclosure and the see-through barrier; and a door assembly including a door coupled to the electric enclosure via a hinge, wherein the door assembly is configured to transition between an open configuration and a closed configuration, and wherein the door is positioned adjacent the see-through barrier in the closed configuration of the door assembly.

2. The terminal unit of claim 1, wherein the terminal unit electronics comprise a controller configured to control operation of the control valve.

3. The terminal unit of claim 1, comprising an electric heater, wherein a portion of the electric heater is positioned within the cavity between the base of the electric enclosure and the see-through barrier.

4. The terminal unit of claim 1, wherein the terminal unit electronics comprise one or more fuses arranged to be visible via the see-through barrier.

5. The terminal unit of claim 1, comprising a connector, wherein a first portion of the connector is located within the electric enclosure between the base of the electric enclosure and the see-through barrier and a second portion of the connector passes through an opening in the see-through barrier.

6. The terminal unit of claim 1, wherein the see-through barrier comprises a polycarbonate sheet.

7. The terminal unit of claim 1, wherein the see-through barrier comprises a mesh.

8. The terminal unit of claim 1, wherein the cavity is a first cavity and the terminal unit comprises a second cavity of the electric enclosure that is separated from the first cavity by an internal wall.

9. The terminal unit of claim 8, wherein the see-through barrier is offset from the second cavity such that the see-through barrier does not block physical access to the second cavity.

10. A terminal unit for a heating, ventilation, and/or air conditioning (HVAC) system, comprising:

a control box assembly including an electric enclosure that defines a cavity therein;

terminal unit electronics disposed within the cavity of the electric enclosure;

a duct assembly including a casing configured to transmit an air flow;

a heater, a fan, a valve, or a combination thereof configured to operate with the terminal unit electronics to adjust one or more aspects of the air flow; and a see-through barrier coupled to the electric enclosure and positioned within the cavity such that the terminal unit electronics are located between a base of the electric enclosure and the see-through barrier.

11. The terminal unit of claim 10, wherein the terminal unit electronics comprise electrical couplings of the heater, the fan, the valve, or the combination thereof.

12. The terminal unit of claim 10, wherein the see-through barrier is coupled to the electric enclosure via brackets that offset the see-through barrier from the base of the electric enclosure by at least a threshold distance.

13. The terminal unit of claim 10, comprising a door assembly, the door assembly including a door configured to transition between an open configuration and a closed configuration, wherein the door is positioned adjacent the see-through barrier in the closed configuration of the door assembly.

14. The terminal unit of claim 13, comprising a connector extending from within the cavity, through an opening in the see-through barrier, and into engagement with the door in the closed configuration.

15. The terminal unit of claim 10, wherein the see-through barrier engages with lips of the electric enclosure that are positioned about a portal into the cavity to resist flexing of the see-through barrier.

16. A terminal unit for a heating, ventilation, and/or air conditioning (HVAC) system, comprising:

an electric enclosure including an interior and a portal into the interior of the electric enclosure;

receptacles of a base of the electric enclosure configured to engage with terminal unit electronics and at least one air flow characteristic management device;

a duct assembly casing coupled to the electric enclosure, wherein the duct assembly casing is configured to transmit an air flow; and a see-through barrier coupled to the electric enclosure and positioned such that physical access to the receptacles via the portal is blocked by the see-through barrier, wherein the see-through barrier comprises a mesh.

17. The terminal unit of claim 16, comprising the terminal unit electronics coupled to the receptacles.

18. The terminal unit of claim 17, comprising the at least one air flow characteristic management device communicatively coupled to the terminal unit electronics and configured to manage characteristics of the air flow transmitted through the duct assembly casing.

19. The terminal unit of claim 16, comprising a connector, wherein a first portion of the connector is located within the electric enclosure between the base of the electric enclosure and the see-through barrier and a second portion of the connector passes through an opening in the see-through barrier.

* * * * *